US006390170B1

(12) United States Patent
Bringard et al.

(10) Patent No.: US 6,390,170 B1
(45) Date of Patent: May 21, 2002

(54) APPARATUS FOR LOCATING AND SECURING SUPPORTS TO PANELS

(75) Inventors: Timothy L. Bringard, Grosse Ile.; Dennis L. Burke, Flat Rock; Thomas N. Potcova, Monroe, all of MI (US)

(73) Assignee: Ace Packaging Systems, Inc., Monroe, MI (US)

( * ) Notice: Subject to any disclaimer, the term of this patent is extended or adjusted under 35 U.S.C. 154(b) by 0 days.

(21) Appl. No.: 09/479,202

(22) Filed: Jan. 7, 2000

(51) Int. Cl.[7] ..... B23Q 3/18

(52) U.S. Cl. ..... 156/562; 156/560; 269/25; 269/43; 269/58

(58) Field of Search ..... 156/297, 556, 156/578, 560, 562; 269/55, 58, 59, 95, 25, 43, 63; 29/559; 414/589

(56) References Cited

U.S. PATENT DOCUMENTS 5,108,355 A 4/1992 Walsh ..... 493/89
5,224,919 A 7/1993 Walsh ..... 493/89
5,820,724 A * 10/1998 Diekwisch ..... 156/382
5,980,440 A 11/1999 Mitman et al. ..... 493/52
6,041,718 A 3/2000 Brandes et al. ..... 108/51.3

* cited by examiner

*Primary Examiner*—Richard Crispino
*Assistant Examiner*—Cheryl N. Hawkins
(74) *Attorney, Agent, or Firm*—Brinks Hofer Gilson & Lione

(57) ABSTRACT

A manufacturing apparatus and method for facilitating, locating and securement of supports or cushioning blocks on a container panel includes a table for receiving the container panel and a bi-directionally, vertically movable frame which receives a template. The frame is raised and lowered by one or more linear actuators which may be double acting, hydraulic or pneumatic cylinders, ball screw operators or similar devices. The template includes a specific pattern of openings which correspond to the desired locations of supports or cushioning blocks. A container panel is placed on the table, the template is disposed in the frame and the frame is lowered onto the panel. An adhesive such as a hot melt adhesive is distributed on the panel through the openings and the supports or cushioning blocks are positioned according to the template on the panel. The frame and template are then lifted off the pad and the completed panel is removed from the apparatus.

14 Claims, 4 Drawing Sheets

APPARATUS FOR LOCATING AND SECURING SUPPORTS TO PANELS

BACKGROUND OF THE INVENTION

The invention relates generally to a method and apparatus for fabricating product support panels for shipping cartons and more specifically to an apparatus having a moveable frame which receives a template having a pattern of openings corresponding to the desired location of supports and cushioning blocks.

The protection during shipment of large, heavy objects is a specialized science. Knowledge of the weight distribution of the object, the likely impacts and forces to which the shipping container will be subjected during shipping are but two of the more significant parameters to be considered during packaging design. Instead of a single large object, shipping cartons are frequently utilized to protect and transport multiple large but still delicate items such as metal stampings for automobile doors, hoods and similar components. Notwithstanding the relative ease with which such components may be warped or distorted during shipment, they are utterly unusable if such damage occurs. Accordingly, safe transport is a necessity and places special demands upon the packaging and packaging designer.

Frequently such cartons or packages include a plurality of strategically located cushioning or support blocks or pads. Inasmuch as the locations of the supports or pads are dictated by the shape of the product, the weight distribution of the contents and often the load bearing capability of the container, repeated and accurate locating of the blocks and pads is critical.

One approach utilized in the past is to mark, through a printing process, the desired location on a given carton or package panel of the supports or blocks. Marking each individual panel, of course, increases their cost due to the additional printing step.

It has also been proposed to score or otherwise mark the desired location for supports or blocks with die cuts during the cutting of the carton panel. This approach has the distinct disadvantage of weakening the panel and has thus been found generally undesirable.

It is thus apparent that an apparatus and method for facilitating the location and securement of support or cushioning pads or blocks on a carton panel would be both desirable and useful.

SUMMARY OF THE INVENTION

A manufacturing apparatus and method for facilitating, locating and securement of supports or cushioning blocks on a carton panel includes a table for receiving the panel and a bi-directionally, vertically movable frame which receives a template. The frame is raised and lowered by one or more linear actuators which may be double acting, hydraulic or pneumatic cylinders, ball screw operators or similar devices. The template includes a specific pattern of openings which correspond to the desired locations of supports or cushioning blocks. A carton panel is placed on the table, the template is disposed in the frame and the frame is lowered onto the panel. An adhesive such as a hot melt adhesive is distributed on the panel through the openings and the supports or cushioning blocks are positioned according to the template. The frame and template are then lifted off the pad and the completed panel is removed from the apparatus.

Thus it is an object of the present invention to provide an apparatus for facilitating accurate securement of cushioning and support pads and blocks to a carton panel.

It is a further object of the present invention to provide an apparatus and method utilizing a moveable frame for receiving a template.

It is a still further object of the present invention to provide an apparatus and method for accepting various templates and panel sizes to produce a variety of assembled components.

Further objects and advantages of the present invention will become apparent by reference to the following description of the preferred embodiment and appended drawings wherein like reference numbers refer to the same component, element or feature.

DESCRIPTION OF THE PREFERRED EMBODIMENT

Figure 1:
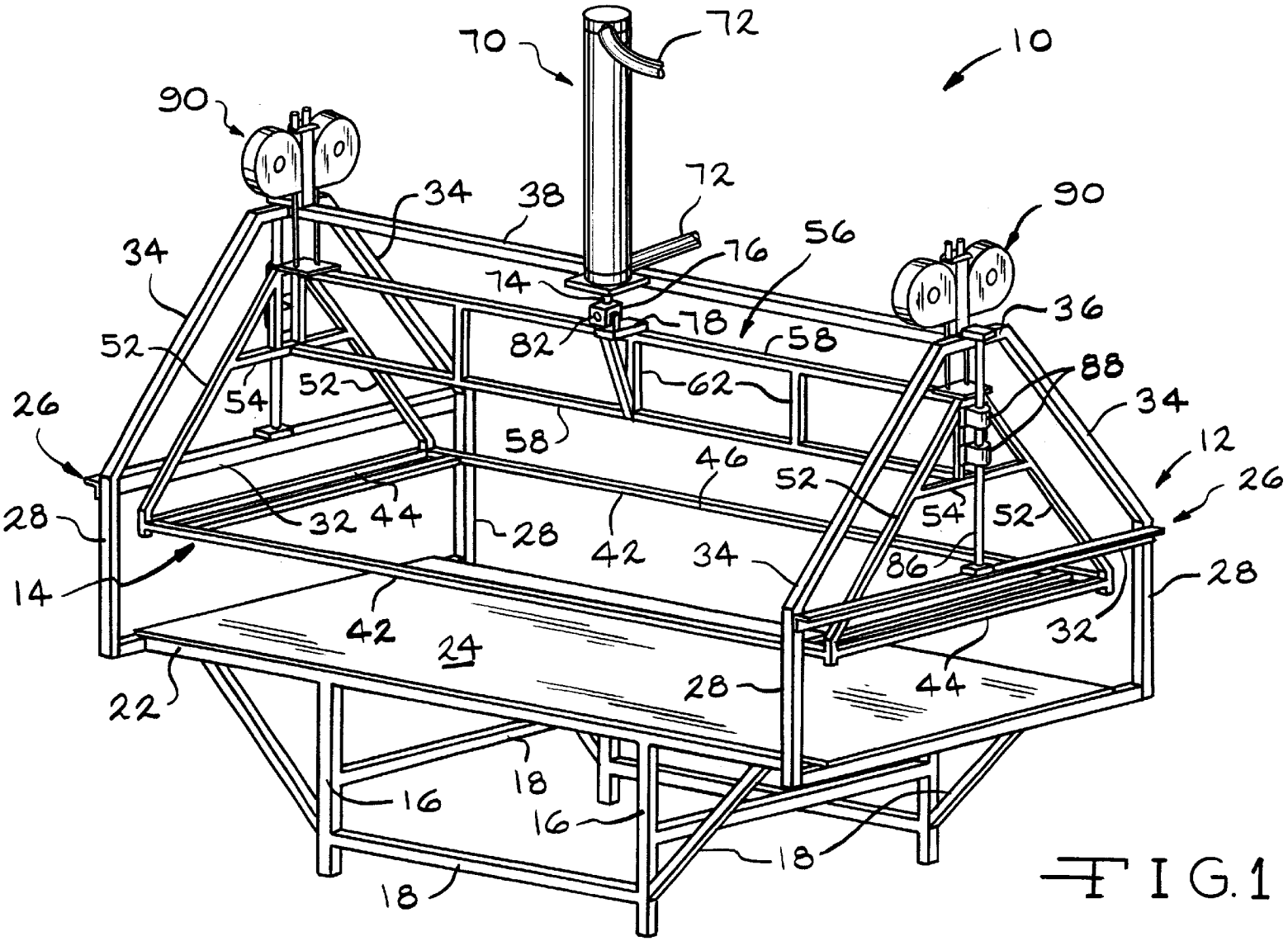
FIG. 1 is a perspective view of an apparatus for locating and securing support blocks on a carton panel having its frame in a raised position.

Referring now to FIG. 1, an apparatus for locating and securing support blocks to panels is illustrated and generally designated by the reference number 10. The apparatus 10 includes a stationary, outer frame assembly 12 and a vertically translatable, inner frame assembly 14. The outer frame assembly 12 includes a plurality of vertical legs 16 and horizontal and oblique braces 18 which rigidly support an elongate table 22. The table 22 defines a planar horizontal surface which received a panel or sheet of cardboard 24. The legs 16 and the braces 18 may be steel angle, channel or box beams of aluminum or cold rolled steel which are welded or secured together by other suitable means such as fasteners to form the outer frame assembly 12.

Preferably, the table 22 is positioned between thirty and thirty-six inches from the supporting floor (not illustrated) to facilitate placement and removal of material such as the cardboard 24 therefrom. At each end of the table 22 is an A-frame assembly 26 having vertical members 28, a horizontal member 32 and symmetrically disposed oblique members 34. The oblique members 34 are coupled to a top stub member 36 which supports a longitudinal top beam 38 which extends between the two top stubs 36 of the respective end frames 26. The just described components of the outer frame assembly 12 are also preferably fabricated of angle, channel or box beams of aluminum or cold rolled steel as desired. Other structural shapes may also be utilized, the important feature being the assembly of a rigid and relatively lightweight outer frame assembly 12 which provides relatively unhindered access to the table 22.

Figure 2:
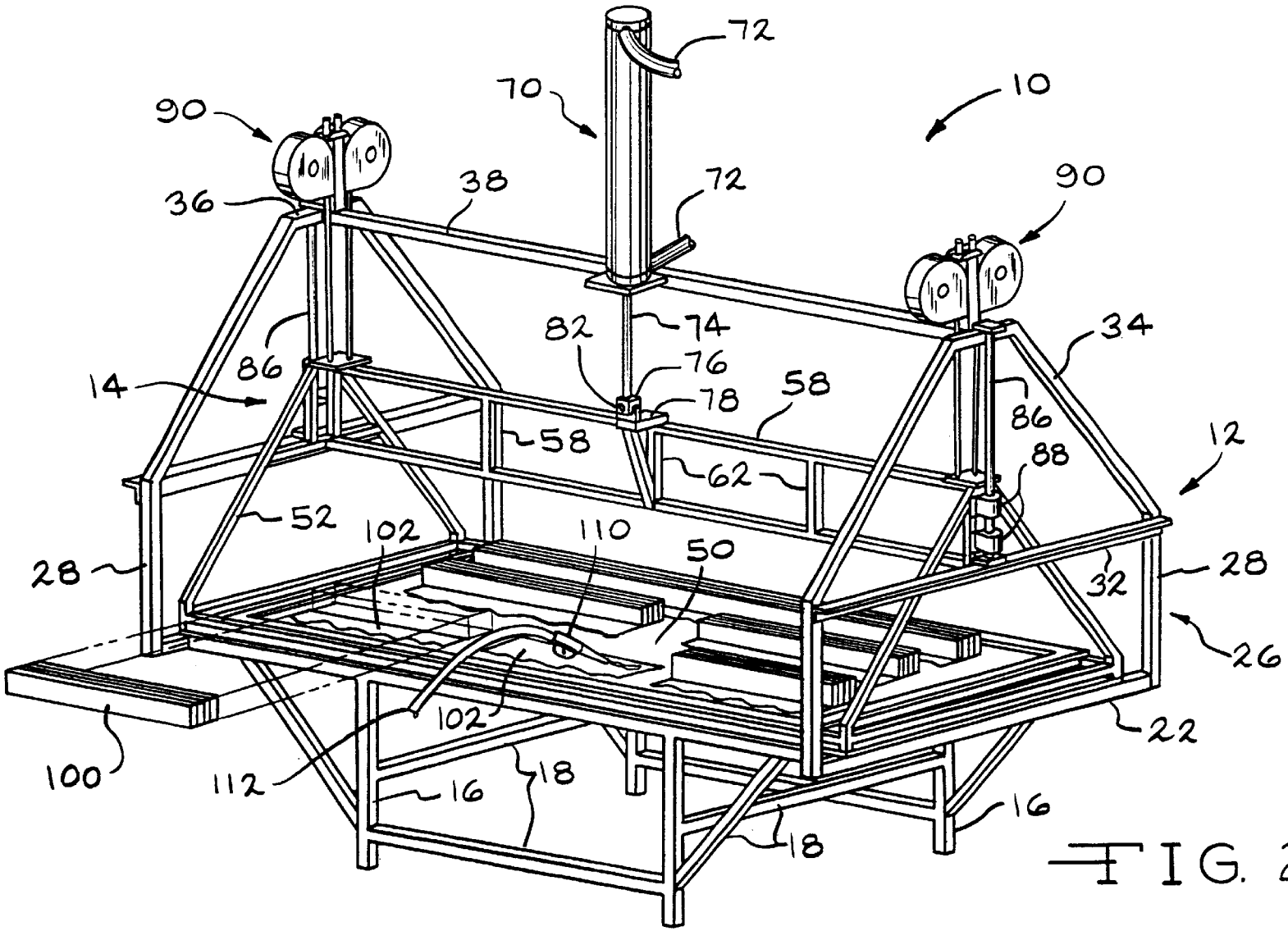
FIG. 2 is a perspective view of an apparatus for locating and securing support blocks with its frame and template in a lowered position and illustrating a plurality of support blocks.

Disposed within the outer frame assembly 12 and having a shape generally similar to the end frames 26 is the inner frame assembly 14. The inner frame assembly 14 includes a pair of parallel, longitudinal beams 42 which are connected at their ends by a plurality of transverse beams 44. These longitudinal beams 42 and the transverse beams 44 cooperatively define a peripheral lip or narrow shelf 46 which receives a template 50 as illustrated in FIG. 2. Extending obliquely from each corner of the inner frame assembly 14 are oblique beams 52 which are secured together at an apex. A transverse brace 54 extends between the oblique members 52 below their apex. Upper and lower longitudinal beams 58 are secured together by vertical braces 62 and extend between the end frames 26.

Referring now to FIGS. 1 and 2, the inner frame assembly 14 is shown in FIG. 1 in a raised or elevated position whereas in FIG. 2 it is shown in a lowered position. Providing the energy to bi-directionally translate the inner frame assembly 14 is a double acting piston and cylinder assembly 70. The piston and cylinder assembly 70 preferably operates off shop air which is supplied to the piston and cylinder assembly 70 through a pair hoses 72. Alternatively, the piston and cylinder assembly 70 may be a single acting assembly with either a spring return or a return achieved by gravity. Also alternatively, the piston and cylinder assembly 70 may operate through the agency of pressurized hydraulic fluid or the piston and cylinder assembly may be replaced by an electrically operated device such as a lead screw actuator or similar component having a two position output. The piston and cylinder assembly 70 is secured to the longitudinal member 38 of the outer frame assembly 12. The piston and cylinder assembly 70 includes a piston rod 74 which is preferably terminated in a clevis 76. The clevis 76 receives a complementary portion of a bracket 78 and a pivot pin 82 which couples the inner frame assembly 14 to the piston rod 74 of the piston and cylinder assembly 70.

At each end of the outer frame assembly 12 is a vertically oriented guide rod 86 which is secured between the transverse beam 32 and the top stub member 36 of each of the outer frame assemblies 12. A pair of linear bearings or bushings 88 are secured at each end of the inner frame assembly 14 and receive a respective one of the guide rods 86. Cooperation between the linear bearings or bushings 88 and the guide rods 86 stabilize the inner frame assembly 14 as it translates vertically and ensures that the inner frame assembly 14 maintains a desired position as it engages the surface 24 of the table 22.

Figure 3:
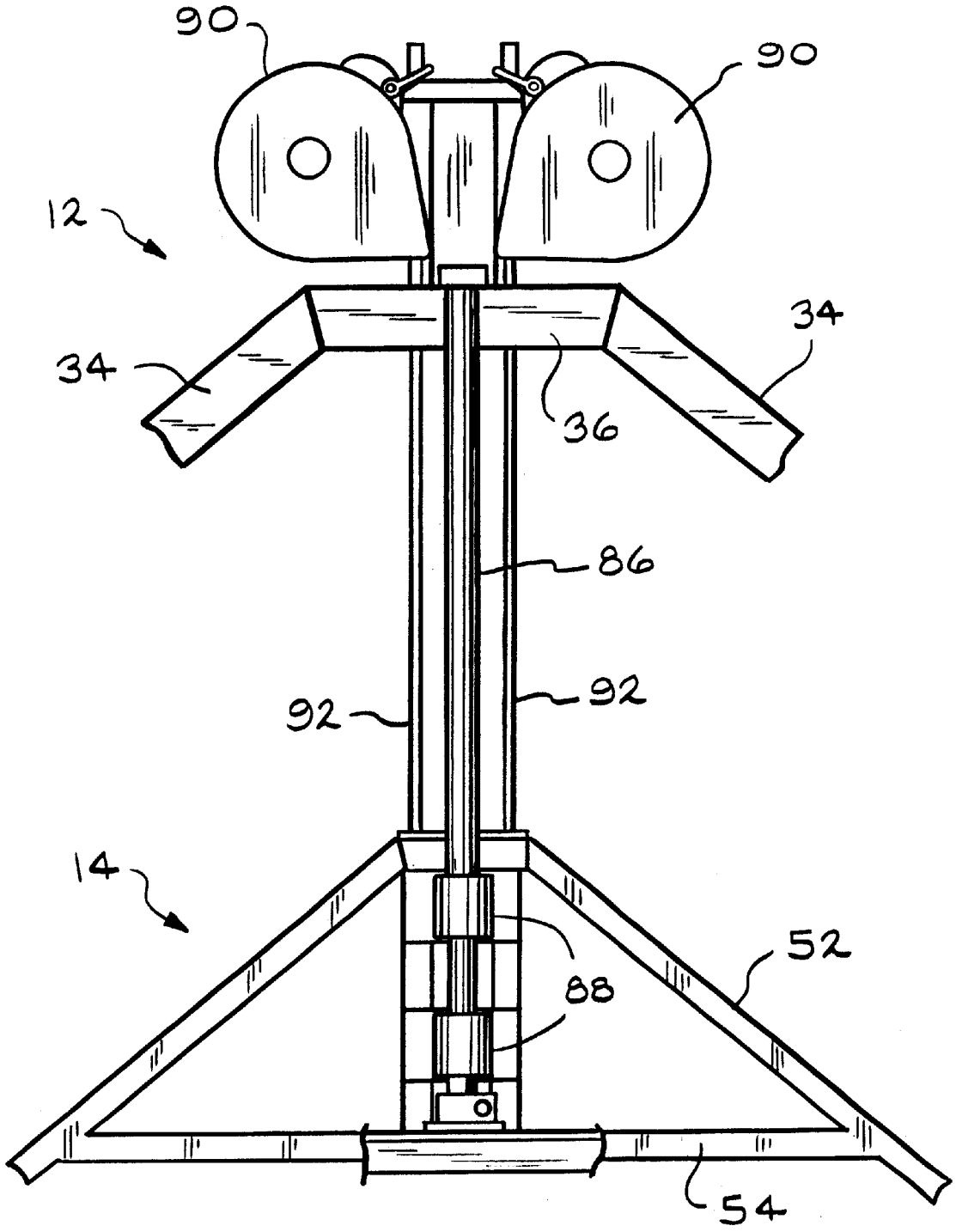
FIG. 3 is an enlarged, end elevational view of a portion of a drive assembly of a frame for an apparatus according to the present invention.

Referring now to FIGS. 1 and 3, a pair of spring biasing assemblies 90 are illustrated. The spring biasing assemblies 90 are commercially available units which include a wound spring (not illustrated) which is coupled to a flexible output cable 92. A pair of the spring biasing assemblies 90 are secured in a symmetrical relationship at each end of the outer frame assembly 12 generally adjacent the top stub member 36 and the cables 92 are secured at each end of the inner frame assembly 14 adjacent the apex. The spring biasing assemblies 90 are adjustable and are adjusted to provide tension in the output cables 92 which substantially counterbalances the weight of the inner frame assembly 14. Accordingly, in operation, the energy that the piston and cylinder assembly 70 must provide to lift the inner frame assembly 14 is significantly reduced, the raising force, to a substantial extent, being supplied by the plurality of spring biasing assemblies 90. Use of the spring biasing assemblies 90 also effectively provides a lifting force at each end of the inner frame assembly 14, thereby smoothing upward and downward motion of the frame assembly 14 and minimizing deflection of the inner frame assembly 14 as well as skewing or cocking thereof.

Figure 4:
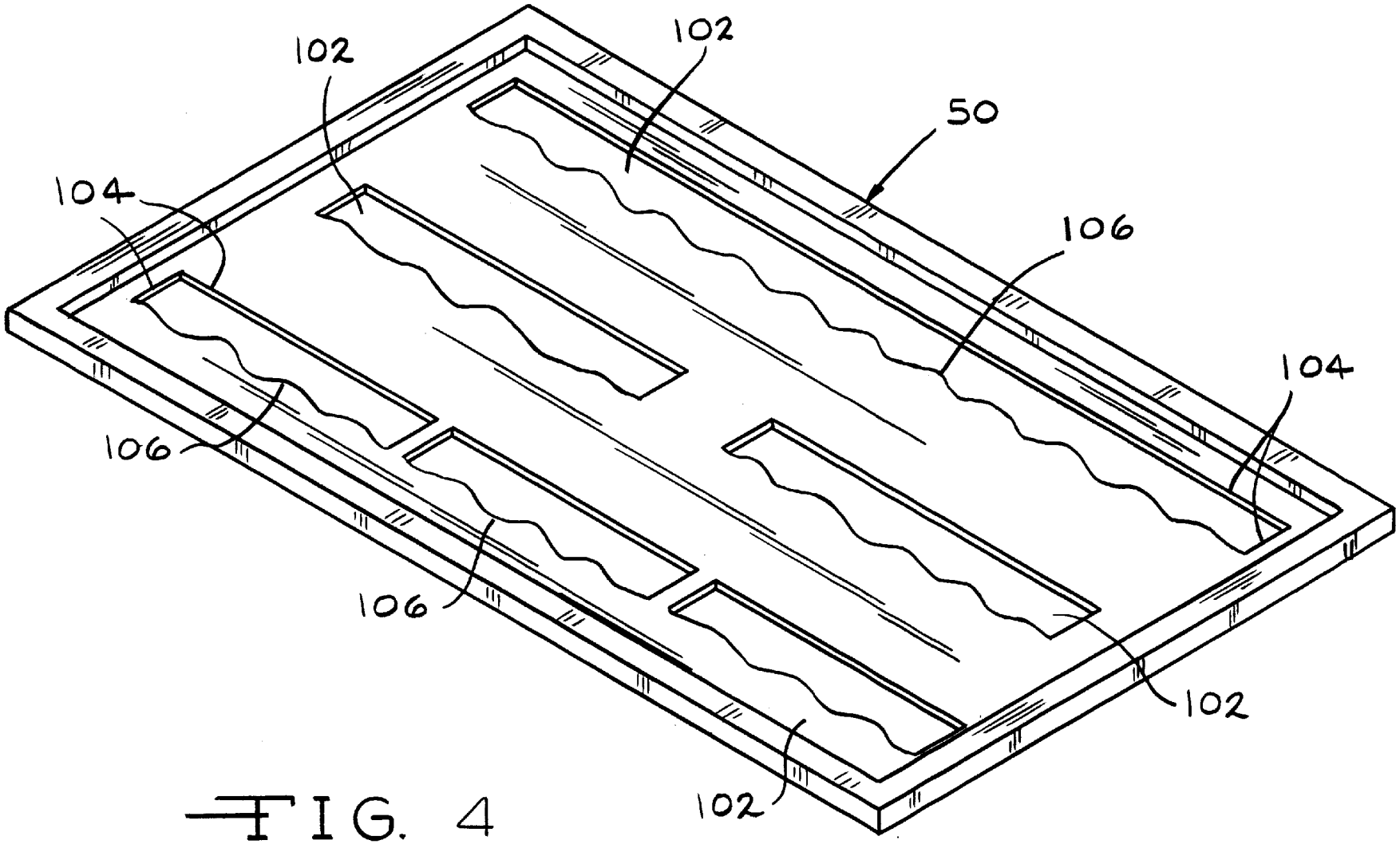
FIG. 4 is a perspective view of a template for use with an apparatus for locating and securing support blocks according to the present invention.

Turning to FIGS. 2 and 4, a typical template 50 for facilitating accurate positioning and securement of cushioning or support blocks or guides 100 to a cardboard panel 24 of a shipping carton, container or other similar product is illustrated. The template 50 defines a length and width substantially equal to the length and width of a panel of corrugated cardboard 24 to which the blocks or guides 100 are to be attached. As such, the template includes a plurality of cutouts 102 which indicate those locations on the cardboard panel 24 at which certain blocks or guides 100 are to be installed. Preferably, the cutouts 102 each include three straight or smooth edges 104 and a fourth scalloped or irregular edge 106. The smooth edges 104 represent those edges against which a block or guide 100 or similar structure should engage when placed within the cutouts 102. The scalloped or irregular edge 106 represents an edge against which a block or guide 100 should not be positioned. This configuration is preferable inasmuch as a block or guide 100 must generally be disposed at a specific location. The backside of that block or guide 100, depending on its location and ultimate purpose, however, may not be critical. This configuration acknowledges this situation. Certain applications, however, may require accurate location of all faces of the block or guides 100 and thus the cutouts 102 may necessarily define four smooth edges or sidewalls 104, thus acting to ensure the accurate location of all sides of a block or guide 100. Such a template cutout 102 also checks and confirms the dimensions of a block or guide, i.e., determines that it is the proper size for the location. It will be appreciated that the template 50 illustrated is exemplary and that templates and the number, size and arrangement of cutouts or openings will vary widely and depend upon a specific application.

Referring now briefly to FIGS. 1, 2 and 4, operation of the apparatus 10 for locating and securing supports to panels will described. As illustrated in FIG. 1, the production cycle begins with the inner frame assembly 14 in its raised or upper position. A sheet or panel of cardboard 24 is placed upon the table 22 and, as shown in FIG. 2, a template such as the template 50 is placed within the lip or shelf 46 of the inner frame assembly 14. The piston and cylinder assembly 70 is then activated to lower the inner frame assembly 14 as shown in FIG. 2. Next, an adhesive such as a hot melt adhesive or similar relatively rapidly curing adhesive is applied by a hand held nozzle or spray head 110 to the cardboard panel 24 through the cutouts 102 in the template 50. The nozzle or spray head may be supplied by the adhesive through a hose 112 or the device may be self-contained. Lastly, and as illustrated in FIG. 2, the support blocks 100 or other features which are preferably fabricated of multiple layers of cardboard are positioned within the cutouts 50 adjacent the smooth edges 104. An appropriate and sufficient period of time is allowed to elapse during which the hot melt or other adhesive is allowed to at least partially cure so that the support blocks 100 remain in their desired position on the panel 24. Then the inner frame assembly 14 is raised by activation of the piston and cylinder assembly 70 and the completed cardboard panel 24 with the support blocks 100 adhered thereto is removed from the assembly 10.

The foregoing disclosure is the best mode devised by the inventor for practicing this invention. It is apparent, however, that apparatus incorporating modifications and variations will be obvious to one skilled in the packaging art. Inasmuch as the foregoing disclosure presents the best mode contemplated by the inventor for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. An apparatus for facilitating attachment of cushioning blocks to panels comprising, in combination, an outer frame assembly having a base frame, a table and a pair of end frames secured to said base frame and including vertical, horizontal and oblique members coupled to a top member, longitudinal top frame member extending between said top members of said end frames, an inner frame assembly disposed within said outer frame assembly and having a rectangular frame, oblique end members converging at an apex and a longitudinal top member extending between said apices, means for vertically translating said inner frame from a first, lowered position on said table to a second, upper position, a vertical guide member disposed on each of said pair of end frames, at least one linear bearing secured to each end of said inner frame assembly and engaging said guide member, and at least one spring biasing assembly disposed at each end of said outer frame assembly and operably coupled to said inner frame assembly.

2. The apparatus of claim 1 wherein said means for translating said inner frame assembly include a piston and cylinder assembly.

3. The apparatus of claim 1 wherein said means for translating said inner frame assembly includes a double acting piston and cylinder assembly.

4. The apparatus of claim 1 further including a template adapted to be disposed on said inner frame assembly, said template defining openings adapted to receive cushioning blocks.

5. The apparatus of claim 1 wherein said beams and members are angle beams secured together by welding.

6. The apparatus of claim 1 wherein said spring biasing assemblies provide a lifting force approximately equal to the weight of said inner frame.

7. The apparatus of claim 1 wherein said means for vertically translating is located midway of said longitudinal top frame member and further including a template having a plurality of openings, said openings having at least one irregular edge.

8. An apparatus for facilitating attachment of cushioning blocks to panels comprising, in combination, an outer frame assembly having a base frame, a table and a pair of end frames secured to said base frame and including vertical, horizontal and oblique members coupled to a top member, a longitudinal top frame member extending between said top members of said end frames, an inner frame assembly disposed within said outer frame assembly and having a pair of ends, a rectangular frame defining a lip oblique, end members converging at an apex and a longitudinal top member extending between said apices, a bi-directional operator for vertically translating said inner frame from a first, lowered position on said table to a second, upper position, a vertical guide member disposed on each of said pair of end frames, at least one linear bearing secured to each of said ends of said inner frame assembly and engaging said guide member, and at least one spring biasing assembly disposed at each end of said outer frame assembly and operably coupled to said inner frame assembly.

9. The apparatus of claim 8 wherein said bi-directional operator includes a piston and cylinder assembly.

10. The apparatus of claim 8 wherein said bi-directional operator includes a double acting piston and cylinder assembly.

11. The apparatus of claim 8 further including a template disposed on said lip of said rectangular frame, said template defining openings adapted to receive cushioning blocks.

12. The apparatus of claim 8 wherein said beams and members are angle beams secured together by welding.

13. The apparatus of claim 8 wherein said spring biasing assemblies provide a lifting force approximately equal to the weight of said inner frame.

14. The apparatus of claim 8 wherein said means for vertically translating is located midway of said longitudinal top frame member and further including a template having a plurality of openings, said openings having at least one irregular edge.

* * * * *